US005501628A

United States Patent [19]

Simmel et al.

[11] Patent Number: 5,501,628

[45] Date of Patent: Mar. 26, 1996

[54] CAM-OPERATED, SYNCHRONIZED MARCHING SOLDIER TRACKWAY

[75] Inventors: Thomas L. Simmel, Milford; Deborah J. McDarren, Ridgefield, both of Conn.

[73] Assignee: Link Group International, Ridgefield, Conn.

[21] Appl. No.: 195,864

[22] Filed: Feb. 14, 1994

[51] Int. Cl.[6] ..... A63H 11/18

[52] U.S. Cl. ..... 446/332; 446/276; 446/355; 446/444; 40/415

[58] Field of Search ..... 446/276, 277, 446/280, 281, 284, 285, 293, 294, 332, 355, 444, 445, 446; 40/411, 414, 415, 418–420

[56] References Cited

U.S. PATENT DOCUMENTS

| | | | |
|---|---|---|---|
| 258,772 | 5/1882 | Kyser et al. | 446/272 |
| 673,587 | 5/1901 | Steward | 40/415 |
| 692,604 | 2/1902 | Bourke | 40/415 |
| 1,237,390 | 8/1917 | Salter | 446/284 |
| 1,322,199 | 11/1919 | Murphy | 446/284 |
| 1,802,884 | 4/1931 | Diederichs | 446/332 |
| 1,816,471 | 7/1931 | Diederichs | 446/332 |
| 2,052,447 | 8/1936 | Coderre | 446/284 |
| 2,055,846 | 9/1936 | Marx | 446/293 |
| 2,115,108 | 4/1938 | Horn | 446/455 |
| 2,265,710 | 12/1941 | Wooten | 446/275 |
| 2,784,525 | 3/1957 | Grierson et al. | 40/415 |
| 2,874,513 | 2/1959 | Connell | 446/332 |
| 2,942,378 | 6/1960 | Ellis | 446/332 |
| 3,672,082 | 6/1972 | Tepper et al. | 446/332 |
| 4,183,172 | 1/1980 | Lewis et al. | 446/332 |
| 4,344,243 | 8/1982 | Reszka | 40/415 |
| 5,127,869 | 7/1992 | Hanzawa | 446/409 |

FOREIGN PATENT DOCUMENTS

| | | | |
|---|---|---|---|
| 2187651 | 9/1987 | United Kingdom | 446/444 |

*Primary Examiner*—Robert A. Hafer
*Assistant Examiner*—Jeffrey D. Carlson
*Attorney, Agent, or Firm*—Melvin T. Stoltz

[57] ABSTRACT

A unique, visually enhancing and exciting entertainment system is obtained by providing an elongated path or track, along which a plurality of objects automatically advance, with the objects constructed to perform independent animated movements in direct synchronization with each other. In addition to the coordinated, synchronized, independent movement of each of the objects as the objects movably advance along the track or pathway, the present invention is also constructed to enable each object to perform a separate and unique activity, completely distinguishable from the normal animated movement being performed by the object as the object moves along the path. In this way, further excitement and visual stimulation is provided and an entertainment system is attained which provides long-term benefits and interest to the viewers.

21 Claims, 10 Drawing Sheets

CAM-OPERATED, SYNCHRONIZED MARCHING SOLDIER TRACKWAY

TECHNICAL FIELD

This invention relates to entertainment assemblies or systems incorporating action figures or objects movable about a track or path and, more particularly, to such entertainment systems wherein the action figures or objects are capable of automatically and repeatedly performing one or more activities.

BACKGROUND ART

The general public has long been fascinated with a variety of entertainment assemblies or systems which arc educational, fun-producing, visually stimulating, and/or conversation enhancing. These entertainment systems or assemblies are constructed in a variety of forms for sale or use by either youth or adults. In spite of the broad spectrum of ages and purposes for which these systems are constructed, these systems generally have similar components, consisting of one or more movable objects and a track or pathway along which the objects controllably advance.

Well-known entertainment assemblies of this general nature arc electric train sets and racing cars sets. These systems are typically constructed with an endless loop track enabling the train, or series of trains, or the car or cars to continuously advance along the track, either automatically or by user control.

Other prior art systems that have been constructed consist of a continuous track along which objects continuously advance. Often, these prior art systems allow the objects being moved to be changeable, in order to increase the level of interest. Typically, these prior art systems employ model figures, such as soldiers, animals, or characters, which are mountable for continuous movement along the track. Other systems employ vehicles, such as automobiles, trolleys, trains, carriages, etc. as the movable objects. Regardless of the particular object employed, each are constructed for independent movement and are advanced along the track by a continuous looped belt which controls and engages a portion of the object, causing the object to continuously travel along the endless loop track.

Although these prior art systems have successfully provided some level of entertainment to the user, their efficacy has been limited, due to the repetitive nature of the activity being performed. Typically, these prior art systems are merely capable of enabling the particular object, either a figure, character, vehicle, or the like, to continuously advance along the predefined pathway established by the track. By constructing the track in a manner so that the loop consists of an endless loop, the object or objects are able to continuously travel for extended periods of time along the track. However, although the motion or movement continues, this motion is the only entertainment provided and, as a result, boredom often rapidly occurs.

Although various attempts have been made to enhance or reduce the repetitive nature of these prior art systems, these prior art entertainment assemblies or systems have been only able to provide visually distinctive objects as the principal method for decreasing the repetitive or boring nature of these prior art systems. However, the continuous movement of visually distinctive objects along the same path for extended periods of time has failed to eliminate the inherent disadvantages and, as a result, has caused such products to be of limited success and broad applicability.

Other prior art systems have attempted to overcome these inherent drawbacks by incorporating sound effects coordinated to the objects. As a result, train systems incorporate various sound effects normally associated with moving trains, while automobile racing tracks incorporate various sounds associated with actual vehicle races at a track. Although the use of such sound effects has enhanced the entertainment value of such prior art systems, the mere addition of such sound effects has been incapable of overcoming the major or principal drawbacks inherent to the repetitive nature of the systems themselves.

Therefore it is a principal object of the present invention to provide an entertainment system or assembly which is capable of providing a visually interesting and exciting movement of a plurality of objects along a predefined path, while also enabling each object to perform one or more visually unique and distinctive activities as the object travels along the path or track.

Another object of the present invention is to provide an entertainment system or assembly having the characteristic features described above which is capable of having all of the objects performing the identical activity in any desired synchronization, thereby providing further visual stimulation and enhanced entertainment.

Another object of the present invention is to provide an entertainment system having the characteristic features described above which is capable of being operated in a continuous endless loop, thereby allowing the objects to repeatedly perform the desired activities on an on-going basis.

Another object of the present invention is to provide an entertainment system having the characteristic features described above wherein a plurality of independent objects are capable of being advanced in association with each other in a self-propelled vehicle, with the vehicle being advanced in a first direction or plane, while each object is capable of performing independent activities in a different direction or plane.

A further object of the present invention is to provide an entertainment system having the characteristic features described above which also enables the objects to be independently dislodged from their normal position while advancing along the track and while also being capable of being automatically repositioned in their original orientation for continued travel along the track.

Another object of the present invention is to provide an entertainment system having the characteristic features described above which is capable of being operated electronically without requiring manual interaction.

Another object of the present invention is to provide an entertainment system having the characteristic features described above which is capable of providing continuous, long-term, dependable operation for providing the desired entertainment on a continuing on-going basis.

Another object of the present invention is to provide an entertainment system having the characteristic features described above which also incorporates musical accompaniment which is automatically changed, depending upon the position of the objects along the track and/or the activity being performed by the objects.

Other and more specific objects will in part be obvious and will in part appear hereinafter.

SUMMARY OF THE INVENTION

By employing the present invention, the prior art drawbacks and limitations have been overcome and a unique entertainment system is realized. As detailed herein, the entertainment system of this invention provides an elongated, preferably endless loop track, along which a plurality of objects automatically advance. However, in order to overcome the prior art limitations, the objects of the present invention are constructed to perform independent animated movements in direct synchronization with each other, thereby providing a substantially visually enhancing and exciting display.

In addition to the coordinated, synchronized, independent movement of each of the objects as the objects movably advance along the track or pathway, the present invention is also constructed to enable each object to perform a separate and unique activity, completely distinguishable from the normal animated movement being performed by the object as the object moves along the path. In this way, further excitement and visual stimulation is provided and an entertainment system is attained which provides long-term benefits and interest to the viewers.

In employing the teaching of the present invention, virtually any desired object can be employed. As a result, objects ranging from figures such as soldiers, marching band members, dancers, sports players, people, animals, characters, etc. can all be employed with equal efficacy. In addition, objects employing any desired type of vehicle, items, shapes, etc., such as automobiles, trains, trolleys, carriages, vases, disks, abstract forms, etc. may also be used in carrying out the teaching of the present invention.

Although any object or combination of objects can be employed, without departing from the scope of the present invention, a plurality of objects comprising marching soldiers is detailed in the specification for exemplary purposes only. As detailed herein, there is no intention that the present invention be limited to marching soldiers and, as will be evident from the detailed disclosure, any desired object, objects, or combination of different objects can be employed using the teaching of this invention, without departing from the scope of this invention.

In employing the teaching of this invention with marching soldiers as the plurality of objects, each soldier is constructed for independent movement as the soldier advances around the track with the soldiers' arms and legs being arcuately movable, in a manner depicting a marching soldier. In addition, in order to further enhance the visual excitement and entertainment aspect of the present invention, each of the soldiers are constructed for marching in synchronization with each other. As a result, all of the soldiers forming the plurality of soldiers are constructed with their left legs moving simultaneously, while their right legs and right arms also move simultaneously. In this way, the visual appearance of marching soldiers is provided.

In order to further enhance the enjoyment and excitement provided by the entertainment system of the present invention, a musical background is also provided. In the preferred construction, a plurality of selected songs or tunes are employed with the position of the marching soldiers being used to transmit a signal which changes the music from one song or tune to another.

Although the attainment of a plurality of independent objects capable of being advanced about a track with each of the object independently moving in synchronization with an associated object represents a substantial advance over any prior art system, and the present invention provides further entertainment, which has previously been incapable of attainment by prior art systems. In the present invention, the track preferably comprises an endless loop with a plurality of marching soldiers being mounted on one or more common platforms or carriers, with each of the individual soldiers being independently movable, as detailed above. As a further visual enhancement and a means for adding additional excitement and entertainment, each marching soldier is constructed to arcuately pivot in its entirety, out of its normal plane of operation upon reaching a particular location along the track. In this way, the soldier provides the visual appearance of falling rearwardly. As the carrier upon which the marching soldiers are mounted continues to advance, each marching soldier repeats the same rearward movement providing a visual cascading or toppling effect or appearance, representing rearward sequential toppling of each of the soldiers in response to the rearward movement of the lead soldier.

Once all of the soldiers have arcuately pivoted rearwardly and advanced for a desired period of time in the fallen position, the soldiers are moved automatically into their normal erect position, in a sequential manner, for immediately resuming their marching activity.

By providing an entertainment system which provides these multiple activities, with one activity physically disrupting the object from its normal plane of operation and causing the object to pivot or rotate into a totally unexpected plane, in combination with each of the other objects, a completely unique system is realized which provides a substantially enhanced level of entertainment and excitement, overcoming all of the prior art objections and drawbacks.

In addition, as is evident from the foregoing discussion, any desired object can be employed in the entertainment system of the present invention. In this regard, dancers, sports figures, animals, characters, etc. can all be constructed to perform a variety of relevant motion activities as the figures advance about the track while also providing a unique, visually distinctive activity, such as arcuately pivoting either forwardly, rearwardly, sideways, or rotating through any desired angle so as to be facing in an alternate direction for a predefined distance along the track. Furthermore, using the teaching of this invention, any other desired unique activity can be incorporated into the entertainment system for providing further enhancement thereof.

The invention accordingly comprises the features of construction, combinations of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
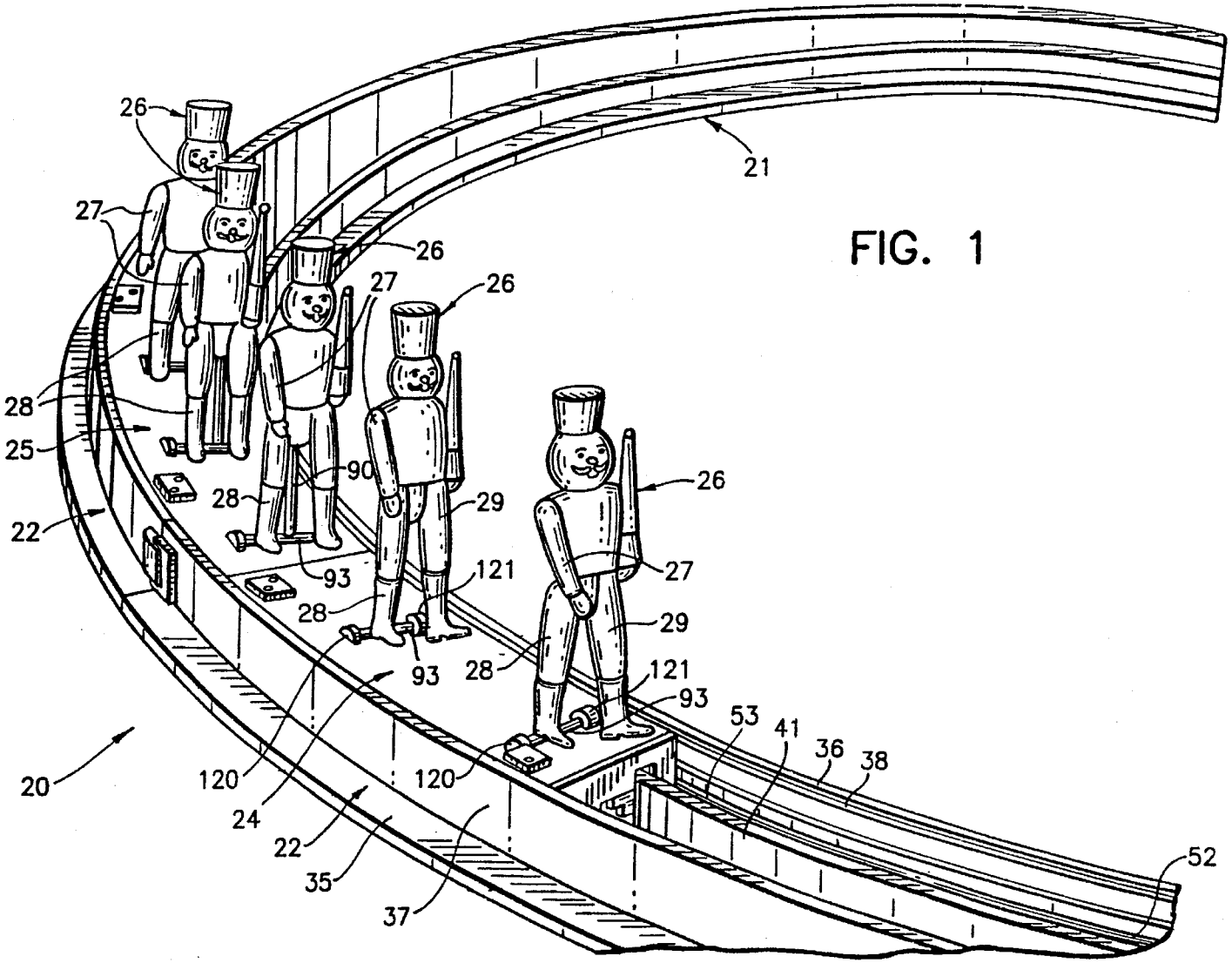
FIG. 1 is a perspective view, partially broken away, of the preferred embodiment of the entertainment system of the present invention.

By referring to FIGS. 1–19, along with the following detailed discussion, the construction and operation of the preferred embodiment of entertainment system 20 of the present invention can best be understood. Throughout these drawings and detailed disclosure, entertainment system 20 is depicted as an endless loop track construction on which marching soldiers are capable of continuously advancing, providing the desired movement and entertainment. However, it is to be understood that the use of marching soldiers is for exemplary purposes only and is not intended, in any way, to limit the scope of present invention.

As detailed above, the present invention can be constructed with a plurality of similar or dissimilar objects being employed for movement on any elongated pathway or continuous track. Consequently, the use of any object in the manner detailed herein is understood to be within the scope of the present invention.

In this embodiment, entertainment system 20 comprises a plurality of track forming segments 22 which are interengaged with each other to form a continuous, preferably circular endless loop track 21. Preferably, each of the track segments 22 are substantially identical to each other and are constructed for being easily mounted together to form track 21.

In this preferred embodiment, entertainment system 20 incorporates carriers 24 and 25 which are movably mounted to track 21, constructed for being continuously advanced along track 21. Carriers 24 and 25 each incorporate a plurality of objects 26, which are independently mounted to carriers 24 and 25. As detailed above, in this embodiment, objects 26 comprise model figures constructed to visually represent marching soldiers.

In order to clearly describe the unique attributes of the present invention, as well as provide the desired high level of entertainment and enjoyment, each object or solider 26 preferably comprises a movable arm 27 and two movable legs 28 and 29. As shown in FIG. 1, each soldier 26 is independently mounted to either carrier 24 or 25 and is constructed for being advanced along track 21 with the movement of carriers 24 and 25.

In addition to the translational movement of each soldier 26 with the movement of carriers 24 and 25, each soldier 26 is also constructed for independently arcuately pivoting or swinging its movable arm 27 while also being constructed for arcuately pivoting its legs 28 and 29. As is fully detailed below, this embodiment of entertainment system 20 is constructed to enable each soldier 26 to arcuately swing its movable arm 27 upwardly at the same time its leg 29 is pivoted forwardly and its right leg 28 is moved rearwardly. In its alternate pattern of movement, the soldier's right leg 28 is pivoted forwardly, while its left leg 29 is moved rearwardly and its arm 27 drops down. In addition, each soldier 26 is controllably constructed for initiating the arm and leg movements detailed above in synchronization with each other, so as to provide the overall visual appearance that soldiers 26 are marching completely in step with each other.

Although entertainment system 20 of the present invention can be constructed with track 21 comprising any desired shape or configuration, the preferred embodiment, as depicted throughout the drawings, comprises an endless loop track 21 formed from a plurality of substantially identical segments 22. Although the overall size, shape and configuration of track 21 can be widely varied, the preferred construction employs an endless loop, circular track having an overall diameter of about forty inches. In addition, in order to attain the desired circular track using a plurality of substantially identical track segments 22, the circular track 21 preferably comprises eight track segments 22, each comprising an overall arcuate length of 45°.

As best seen in FIGS. 2–5, each track segment 22 comprises a base 35 to which side rails 36 and 37 are mounted. Preferably, side rails 36 and 37 are mounted substantially perpendicularly to base 35, with side rail 36 incorporating an elongated, substantially continuous channel or slot 38 formed directly adjacent the free edge of rail 36. Similarly, upstanding side rail 37 incorporates an elongated, substantially continuous channel or slot 39 formed therein substantially adjacent its free end.

Side rails 36 and 37 are positioned in juxtaposed, spaced, cooperating relationship and are mounted at a spaced distance slightly greater than the width of carriers 24 and 25. In this way, side rails 36 and 37 define the elongated, substantially continuous sides along which carriers 24 and 25 advance.

In order to enable the desired movement of carriers 24 and 25 to be obtained, as well as the desired controlled movement of soldiers 26, each track segment 22 incorporates upstanding rails 40 and 41, both of which are substantially perpendicularly mounted to base 35 and positioned between side rails 36 and 37. In addition, track segment 22 also incorporates an elongated gear-toothed bearing rack member 42 mounted to base 35, preferably directly adjacent upstanding rail 40.

Figure 2:
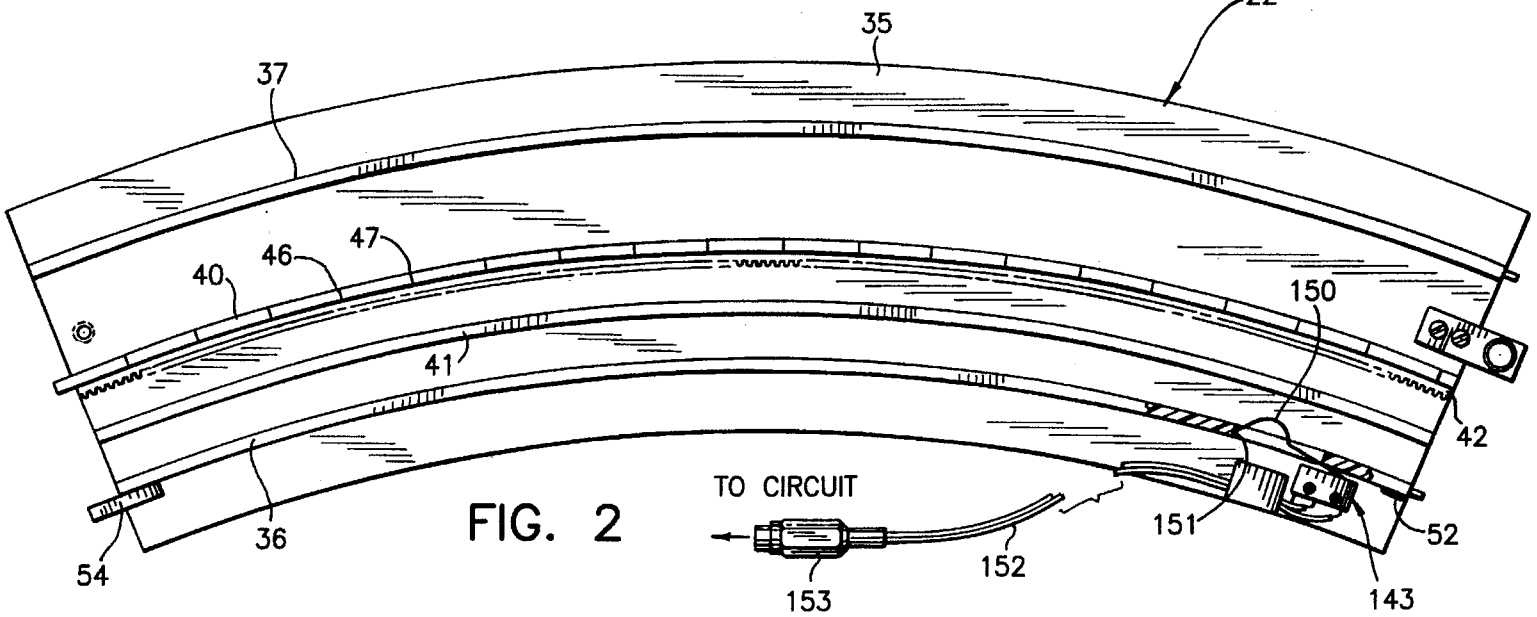
FIG. 2 is a top plan view, partially in cross-section and partially broken away, showing one track segment of the track employed in the entertainment system of the present invention.
Figure 3:
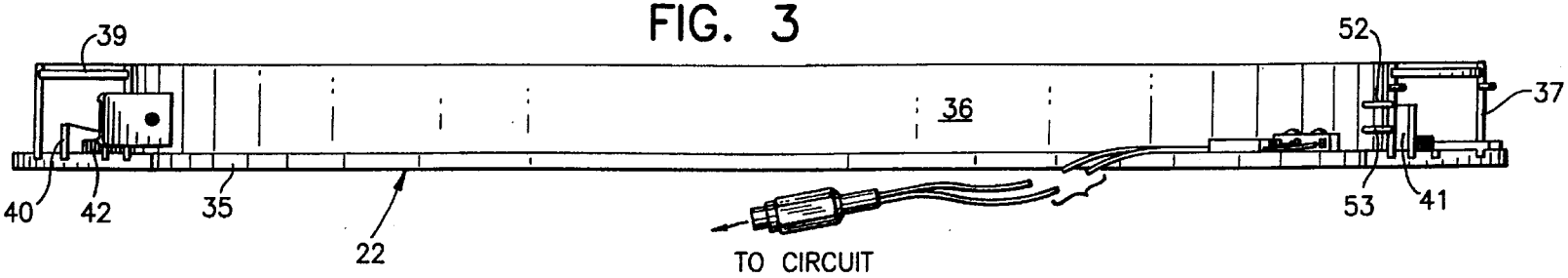
FIG. 3 is a side elevation view of the track segment depicted in FIG. 2.
Figure 4:
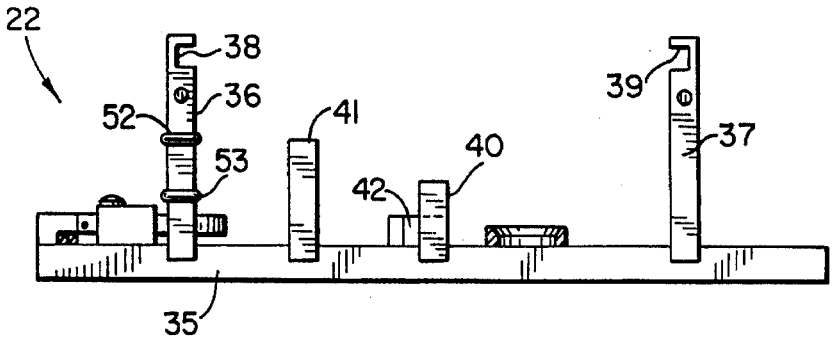
FIG. 4 is an end elevation view of the track segment employed in the present invention taken along line 4—4 of FIG. 2.
Figure 5:
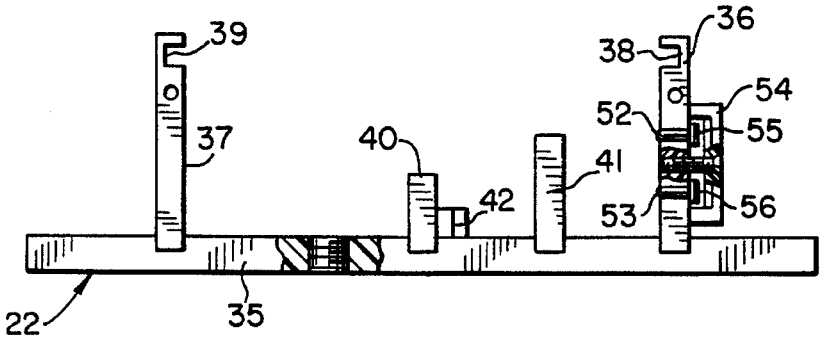
FIG. 5 is an end elevation view of the track segment employed in the present invention taken along line 5—5 of FIG. 2.
Figure 10:
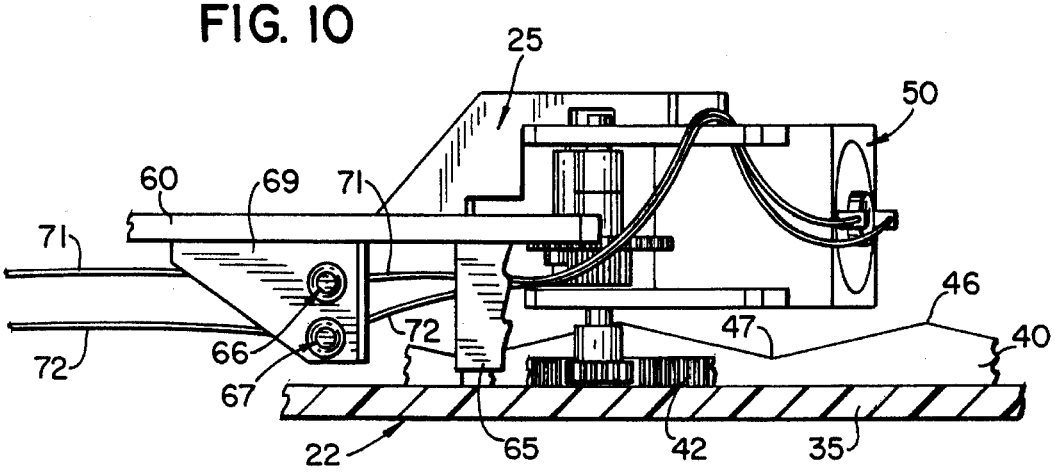
FIG. 10 is a side elevation view, partially in cross-section and partially broken away, depicting the rear carrier with its motor portion mounted in driving engagement with a track segment.
Figure 11:
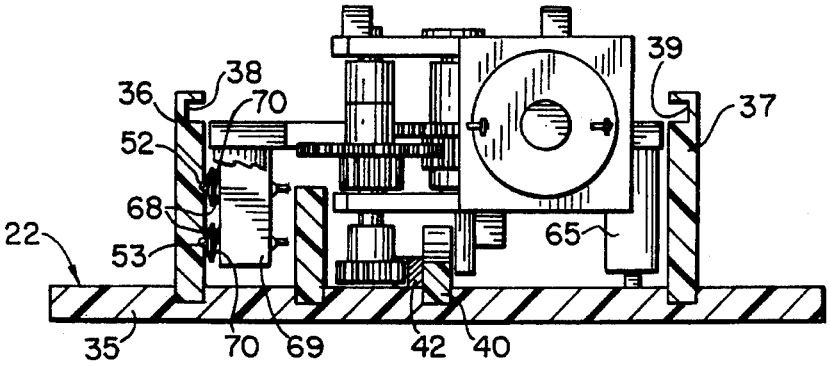
FIG. 11 is a cross-sectional end elevation view depicting the rear carrier portion and associated motor mounted in advancing engagement with a track segment of the entertainment system of the present invention.

As best seen in FIGS. 2 and 10, upstanding rail 40 is constructed with its upper edge formed with a repeating pattern of upwardly and downwardly sloping segments extending continuously along the entire length of rail 40, forming a plurality of peaks 46 and a plurality of valleys 47. As is more fully detailed below, the repeating adjacent sloping segments, and resulting peaks 46 and valleys 47 of rail 40 establish a camming surface for controlling the arm and leg movements of each soldier 26.

Upstanding rail 41 of track segment 22 is employed to control the arcuate pivoting movement of each soldier 26 in its entirety relative to carriers 24 and 25. This movement provides the additional visually exciting, entertaining and enhancing effect of having the soldiers falling rearwardly, one after the other, in a sequential cascading or rearward toppling effect, and then being automatically reset to their original marching position. The overall construction of upstanding rail 41 which provides this desired controlling motion is detailed below.

In the preferred embodiment, carriers 24 and 25 are automatically driven about track 21 by motor assembly 50, which is preferably mounted at the rear of carrier 25. As best seen in FIGS. 8–11, motor assembly 50 comprises a generally conventional electrically driven motor having a gear train terminating with a drive gear 51 which is interengaged with elongated gear-toothed rack member 42 of track segment 22. As a result, whenever motor assembly 50 is activated, drive gear 51 is rotationally driven, causing drive gear 51 to continuously advance along elongated gear-toothed rack member 42 in locked engagement therewith, driving carriers 24 and 25 along track 21.

In the preferred embodiment, motor assembly 50 comprises an electrically driven motor which is supplied with the requisite power, once activated, in order to enable motor assembly 50 to continuously rotate drive gear 51, causing the advance of carriers 24 and 25 along track 21. Although a plurality of alternate drive systems can be employed, use of electrically driven motor assembly 50 along with electrical contacts formed in track segment 22 is preferred.

As best seen in FIGS. 1–11, side rails 36 of track segment 22 comprises continuous, elongated electric signal conducting wires 52 and 53 formed therein. In the preferred embodiment, conducting wires 52 and 53 extend continuously along the inside surface of the entire length of upstanding rail 36 of track segment 22, with the terminating ends thereof being wrapped around rail 36 to be exposed on the opposed, outer surface of rail 36.

One end of track segment 22 incorporates connector 54 mounted to the exposed terminating ends of conducting wires 52 and 53, incorporating elongated, flexible contacts 55 and 56 extending outwardly therefrom. With flexible contacts 55 and 56 of connector 54 formed on each track segment 22 at either the forward end or rear end thereof, each track segment is capable of being electrically interconnected with the adjacent track segment. As is evident from the foregoing discussion, when two track segments 22 are mounted in juxtaposed, interengagement with each other, with the forward end of one track segment in abutting contact with the rear end of the adjacent track segment, flexible contacts 55 and 56 engage the exposed terminating ends of conducting wires 52 and 53 of the adjacent track segment 22, providing the desired electrical conductivity thereto. As a result, once track segments 22 have been fully assembled, the resulting track 21 is capable of conducting the electrical current throughout the entire track, assuring the continuous delivery of electrical power to motor assembly 50.

By referring to FIGS. 1 and 6–11, along with the following detailed discussion, the preferred construction and powered movement of carriers 24 and 25 along track 21 can best be understood. In the preferred embodiment, carriers 24 and 25 each comprise a support base 60 to which soldiers 26 are pivotally mounted. In order to securely support and enable each soldier 26 to be pivotally moved relative to support base 60, support base 60 incorporates a plurality of soldier receiving slots 61.

As mentioned above, motor assembly 50 is preferably mounted to the rear of support base 60 of carrier 25. Although alternate constructions can be employed, it is preferred that carriers 24 and 25 be driven from the rear through the driving system detailed above. In order to assure that carriers 24 and 25 are capable of longitudinal movement along track 21, while being rearwardly driven, without locking or jamming, carrier 25 incorporates a connecting pin 62 mounted on its leading edge while carrier 24 incorporates a pin-receiving aperture 63 mounted along a cooperating terminating end of support base 60 of carrier 24. In this way, carriers 24 and 25 are integrally joined to each other with a single pivot connection, thereby enabling both carriers to move side-to-side, independently of each other. This assures that minor variations in track 21 will not cause stalling or jamming of carriers 24 or 25.

Figure 7:
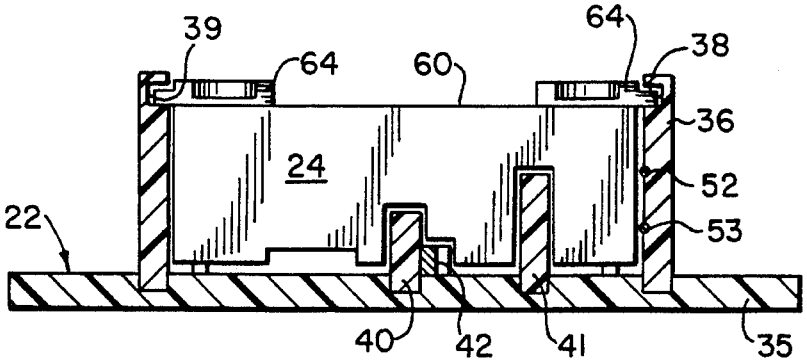
FIG. 7 is a cross-sectional end elevation view of the track segment with the front of the lead carrier depicted mounted thereto taken along line 7—7 of FIG. 6.
Figure 6:
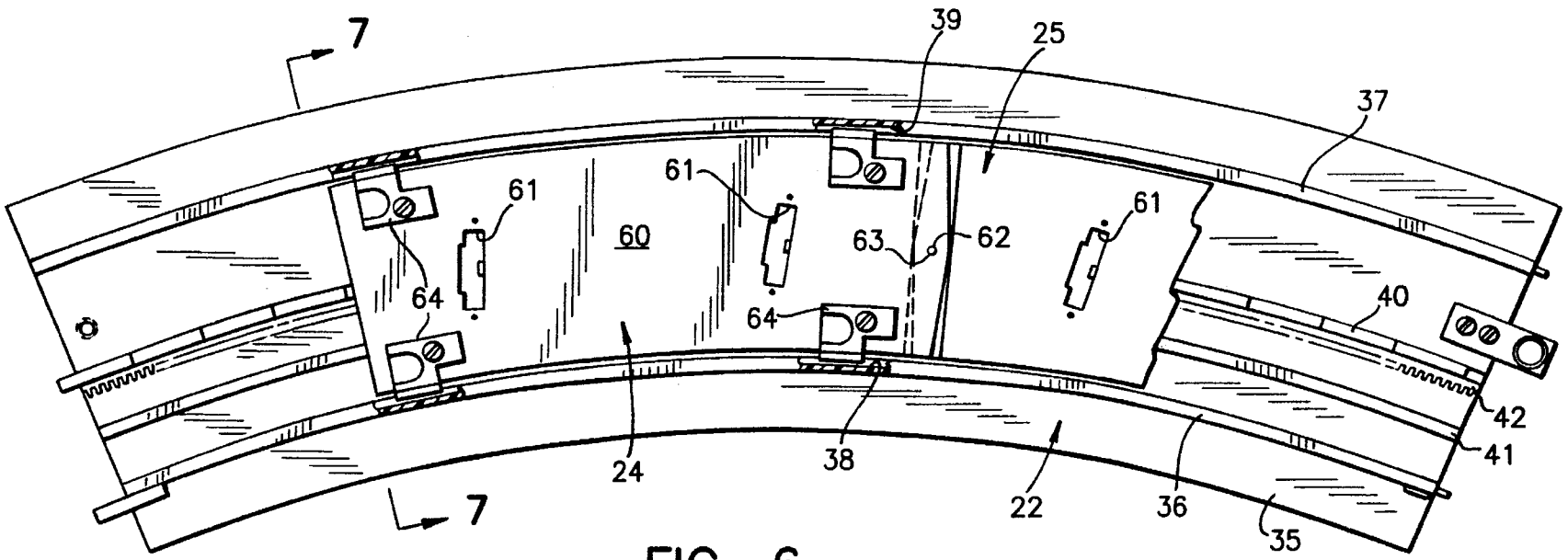
FIG. 6 is a top plan view, partially in cross-section and partially broken away, depicting one track segment employed in the track of the present invention with two carriers mounted to the track segment.
Figure 8:
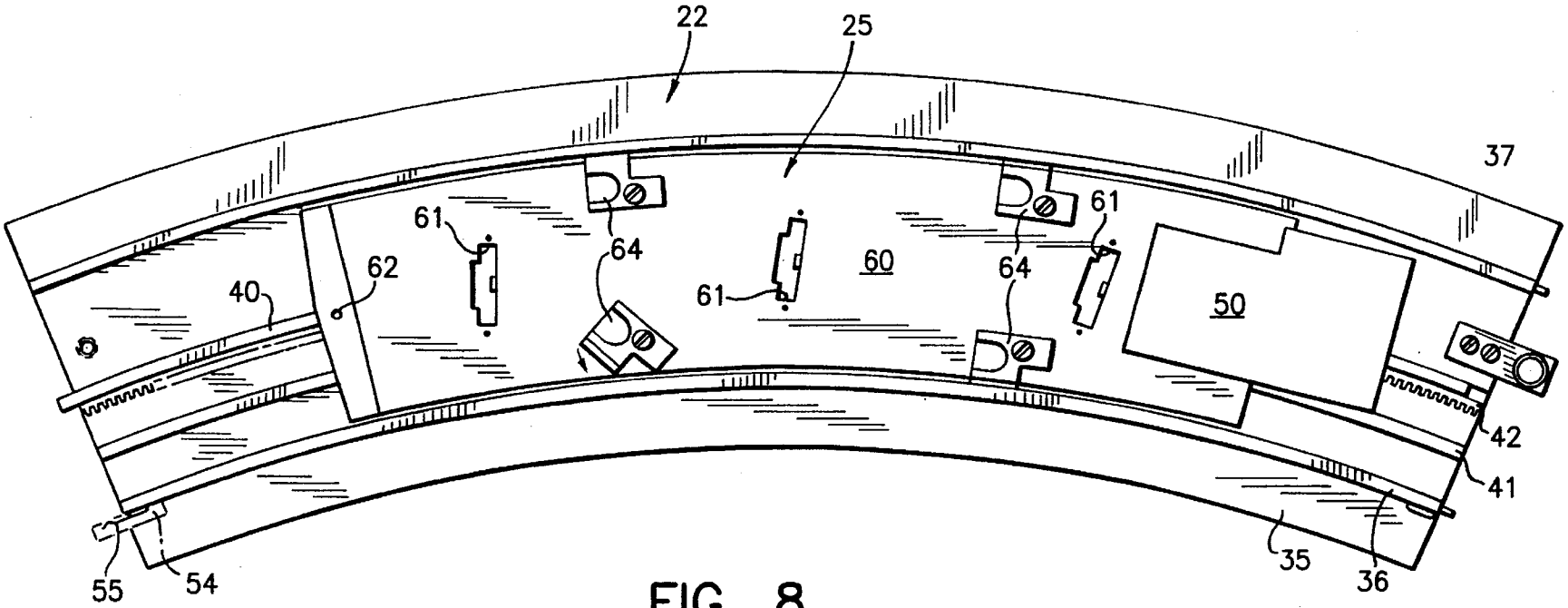
FIG. 8 is a top plan view depicting the track segment employed in the entertainment system of the present invention with the rear carrier mounted in sliding engagement therewith.
Figure 9:
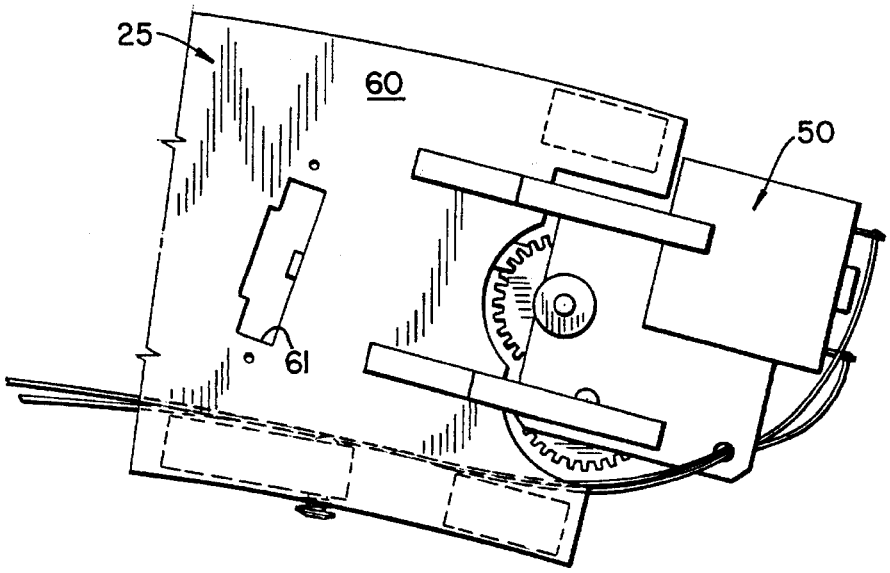
FIG. 9 is a top plan view of the rear carrier portion employing the entertainment system of the present invention partially broken away, depicting the motor drive assembly.

In order to further enhance and assure smooth, continuous advancement of carriers 24 and 25 along track 21, carriers 24 and 25 each comprise a plurality of pivotable supporting flange members 64 mounted to the top surface of support base 60. As best seen in FIGS. 6–8, supporting flange members 64 are mounted on both sides of base 60 of carriers 24 and 25, positioned for having a side edge thereof interengageable with elongated channel 38 of side rail 36 and elongated channel 39 of side rail 37. By employing supporting flange members 64 which are engageable within elongated channels 38 and 39 of side rails 36 and 37, carriers 24 and 25 are supportingly maintained in the precisely desired position, with the side edges of flange members 64 assuring continuous, smooth, advancing interengagement of carriers 24 and 25 within track 21.

In addition, by constructing supporting flange members 64 in a manner which allows them to be easily pivoted into and out of engagement with channels 38 and 39, carriers 24 and 25 are easily positioned in secure, locked, advancing interengagement with track 21, as well as removed from engagement with track 21, whenever desired.

In order to provide further assurance that support base 60 of carriers 24 and 25 continuously and smoothly advance along track 21, support base 60 of carriers 24 and 25 also incorporate supporting posts or plates 65 extending downwardly from base 60, positioned for sliding, contacting, interengagement with base 35 of track segment 22. If desired, supporting posts or plate 65 may incorporate a rotatable wheel for providing further smooth, continuous advancement of carriers 24 and 25.

Alternatively, supporting posts or plate 65 may merely comprise a smoothly rounded terminating ends which are capable of sliding interengagement with base 35 whenever contact between the terminating end of supporting post or plate 65 and base 35 occurs. In this construction, flange members 64 engage elongated channels 38 and 39 in a manner which assures that the terminating ends of supporting posts or plates 65 are maintained spaced above base 35 of track segment 22. In this way, the weight of carriers 24 and 25 is maintained between flange members 64 and elongated channels 38 and 39. As a result, supporting posts or plates 65 are employed for assuring that any dimensional variations or additional, unexpected weight will not bind flange members 64 in elongated channels 38 and 39, and continuous, smooth advancement of carriers 24 and 25 along track 21 is assured.

In order to provide the desired power to motor assembly 50 and enable motor assembly 50 to rotate drive gear 51 to continuously advance carriers 24 and 25 along track 21, carrier 25 incorporates flexible contact assemblies 66 and 67 mounted along the side of support base 60 which is positioned for being advanced adjacent side rail 36 of track segment 22. Preferably, two sets of flexible contact assemblies 66 and 67 are mounted to support base 60 of carrier 25, with one set positioned near the leading edge of carrier 25 and the other set of contact assemblies being positioned near the trailing end of carrier 25.

Flexible contact assembly 66 is positioned for sliding, continuous contacted interengagement with conducting wire 52, while flexible contact assembly 67 is positioned for continuous, sliding, contacting interengagement with conducting wire 53. In this way, once the system has been powered and electricity is continuously delivered to conducting wires 52 and 53, which extend about the entire track 21, electrical power is transmitted through contact assemblies 66 and 67, directly to motor assembly 50. As a result, the requisite power is delivered to motor assembly 50 for enabling motor assembly 50 to operate in its normal manner, advancing carriers 24 and 25 along track 21.

Without departing from the scope of the present invention, flexible contact assemblies 66 and 67 can be constructed in a variety of alternate ways. Regardless of the construction employed, the sole requirement is that contact assemblies 66 and 67 be mounted to carrier 25 in a manner that assures the delivery of the electricity from conducting wires 52 and 53 to motor assembly 50. As an example of an efficient and inexpensive construction, contact assemblies 66 and 67 are depicted incorporating a post member 68 mounted for axial movement in a support panel 69. In addition, spring means 70 are mounted between post 68 and support panel 69 in order to continuously bias post 68 in the fully extended position.

In addition, power conducting wire 71 extends between pin assemblies 66 and to motor assembly 50. Similarly, a second, independent conducting wire 72 extends between pin assemblies 67 and to motor assembly 50 in order to assure the circuit is completed and the desired electrical power is delivered to motor 50 in the desired manner.

By employing this construction, axially movable posts 68 are continuously biased into contacting engagement with conducting wires 52 and 53, assuring that any variations in dimension are easily accommodated and do not cause interruption of power. With post members 68 maintained continuously biased outwardly, contacting engagement between post members 68 and conducting wires 52 and 53 is assured. In this way, the desired power is continuously delivered to motor assembly 50 in order to assure its continuous, uninterrupted operation whenever desired.

By referring to FIGS. 1 and 12–18, along with the following detailed disclosure, the preferred construction for attaining the desired multiple actions of objects 26 can best be understood. The construction detailed herein is employed as one example of a construction that can be used for attaining the multi-action results. However, numerous other systems can be employed, without departing from the scope of this invention. Consequently, this disclosure and the details provided herein regarding the operation of soldiers 26 for marching and falling are intended merely as one example of the type of construction for entertainment system 20, coming within the scope of the present invention.

In the preferred construction, each soldier 26 comprises a body portion 80 to which is affixed head portion 81. Body portion 80 incorporates a fixed left arm, while right arm 27 is pivotally mounted to body portion 80.

In the preferred embodiment, right arm 27 is securely affixed to support rod 82 with support rod 82 being rotationally journalled in body portion 80. In addition, radial pin 83 extends from support rod 82 and is employed to control the arcuate pivoting motion of rod 82 and arm 27.

Legs 28 and 29 are pivotally mounted to body portion 80 near the base thereof, by employing post 86. In the preferred embodiment, post 86 is securely affixed to one of the legs, depicted as leg 28 and extending from the upper portion of leg 28 through body portion 80. The opposed distal end of post 86 is mounted to leg 29 by fastening means 87 in a manner which enables leg 29 to pivot relative to post 86. In this way, both legs 28 and 29 are fully pivotable relative to each other.

The construction of soldier 26 is completed by mounting body portion 80 of soldier 26 to soldier support assembly 90. In the preferred embodiment, support assembly 90 extends into body portion 80, providing the requisite supporting holding of soldier 26, enabling soldier 26 and to be mounted to carriers 24 and 25.

In the preferred construction, support assembly 90 comprises an elongated hollow shaft 91 and an elongated coaxially aligned rod 92 mounted within hollow shaft 91. Rod 92 is constructed for sliding, coaxial movement relative to shaft 91.

Elongated hollow shaft 91 also incorporates cylindrically shaped support tube 93 fixedly mounted adjacent the lower terminating end thereof. Support tube 93 is dimensioned for cooperative pivoting interengagement in slots 61 of support base 60 formed in carriers 24 and 25. In the preferred embodiment, tube holding support members are affixed within slots 61 in a manner which enables cylindrically shaped support tube 93 to be pivotable relative to support base 60 of carriers 24 and 25. In this way, the arcuate rearward pivoting movement of soldiers 26 is attained. The control means employed for providing this arcuate pivoting motion is detailed below.

Cylindrically shaped support tube 93 incorporates a control arm 94 radially extending therefrom positioned directly adjacent elongated rod 92. As is fully detailed below, control arm 94 is positioned for sliding, contacting engagement with upstanding rail 41 of track segment 22 and is employed to control the arcuate rearward and forward pivoting motion of soldier 26.

In order to provide the desired movement of arm 27 and legs 28 and 29, elongated, coaxially aligned rod 92 incorporates a cam holding bracket 104 mounted at the terminating end of rod 92 and a cam follower/roller 95 rotationally journalled in bracket 104. In addition, elongated rod 92 also incorporates fastening posts or screws 96, 97, and 98 each of which are mounted to rod 92, extending substantially perpendicularly therefrom for movement with rod 92 whenever rod 92 moves longitudinally within shaft 91.

In the preferred construction, each post 96, 97, and 98 extends, substantially perpendicularly or radially, from rod 92 extending therefrom through an elongated slot 99 formed in shaft 91. In this way, the maximum movement of rod 92 in shaft 91 is controlled by controlling the overall length of slots 99.

Support assembly 90 incorporates bar 100 mounted to rod 92, preferably employing fastening means 101. In this preferred construction, bar 100 is mounted with its axis parallel to the axis of rod 92 and shaft 91, with fastening means 101 being movable within associated slot 99.

Soldier support assembly 90 also incorporates coil spring means 107 which is mounted with one end thereof affixed to shaft 91 adjacent tube 93 and with its opposed end securely affixed to post 96. By employing coil spring 107 with elongated slots 99, rod 92 is assured of being movable between two alternate positions, automatically returning to its original position when axial movement force is removed. In this regard, when cam follower/roller 95 is outwardly extended from shaft 91 to its maximum extend, pins 96, 97, and 98 are mounted in the lower terminating end of slots 99. In addition, when in this position, coil spring 107 is in its relaxed, unextended configuration.

In its alternate position, when elongated rod 92 has been advanced upwardly into shaft 91, to the maximum extent, posts 96, 97 and 98 are in the upper terminating end of slots 99 and coil spring 107 is fully extended. Consequently, whenever the camming force acting upon cam follower/roller 95, which causes rod 92 to be longitudinally advanced upwardly through shaft 91, the forces of coil spring 107 automatically causes rod 92 to be drawn downwardly into its original position.

The construction for support assembly 90 is completed by securely affixing one end of a control wire 108 to post 97 with the opposed end thereof mounted in controlling engagement with leg 29 at a position directly adjacent post 86. In addition, a second control wire 109 is mounted with one end thereof securely affixed to post 98 and with its opposed end controllably affixed to leg 28. In the preferred construction, control wires 108 and 109 are mounted to their respective leg members with one wire positioned forward of post 86 and the other wire positioned rearwardly of post 86. In this way, the movement of control wires 108 and 109 in response to the axial movement of rod 92 within shaft 91 causes legs 28 and 29 to arcuately swing in the precisely desired, opposite directions.

Figure 12:
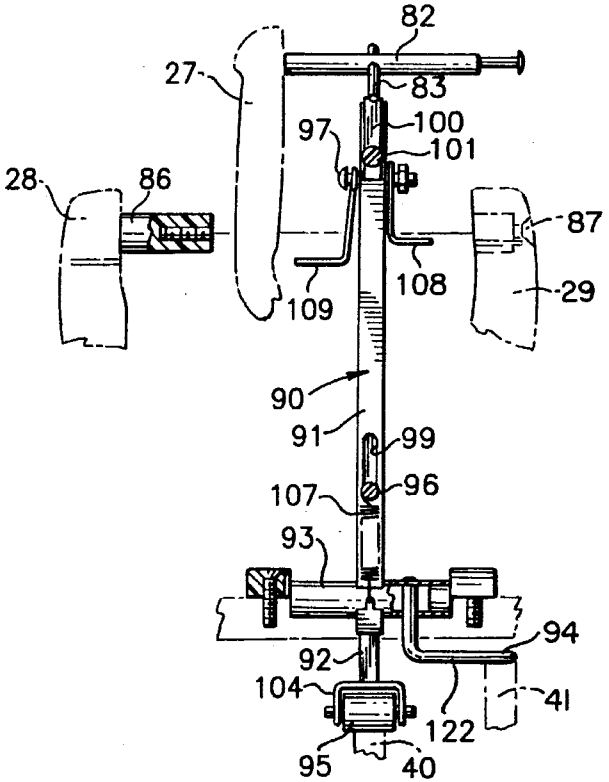
FIG. 12 is a front elevation view of the camming mechanism for operating the movement of the objects.
Figure 14:
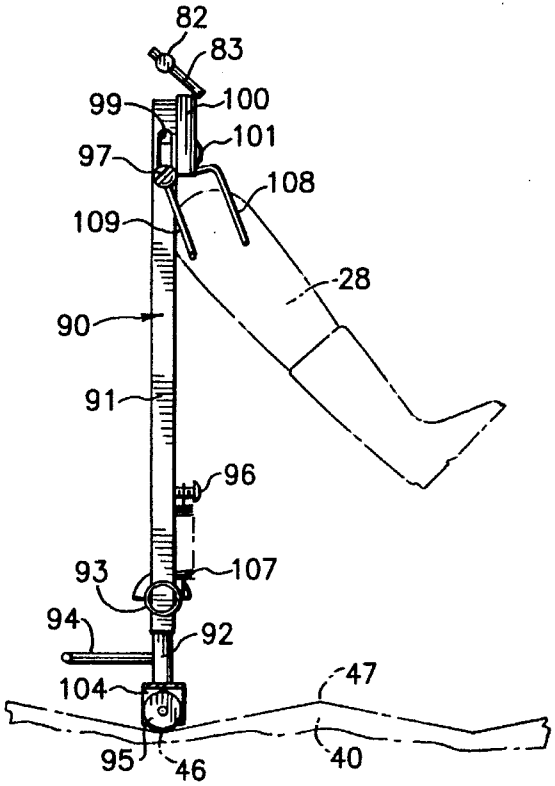
FIG. 14 is the opposed side elevation view of the camming mechanism of FIG. 12.
Figure 13:
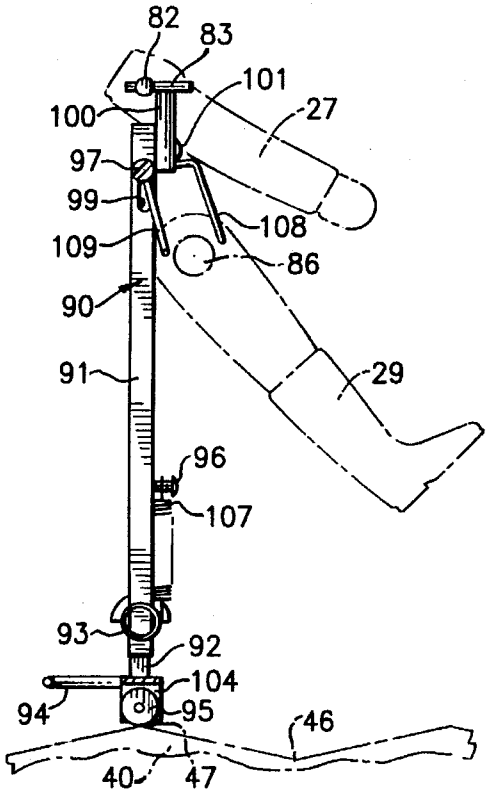
FIG. 13 is a side elevation view of the camming mechanism of FIG. 12.
Figure 16:
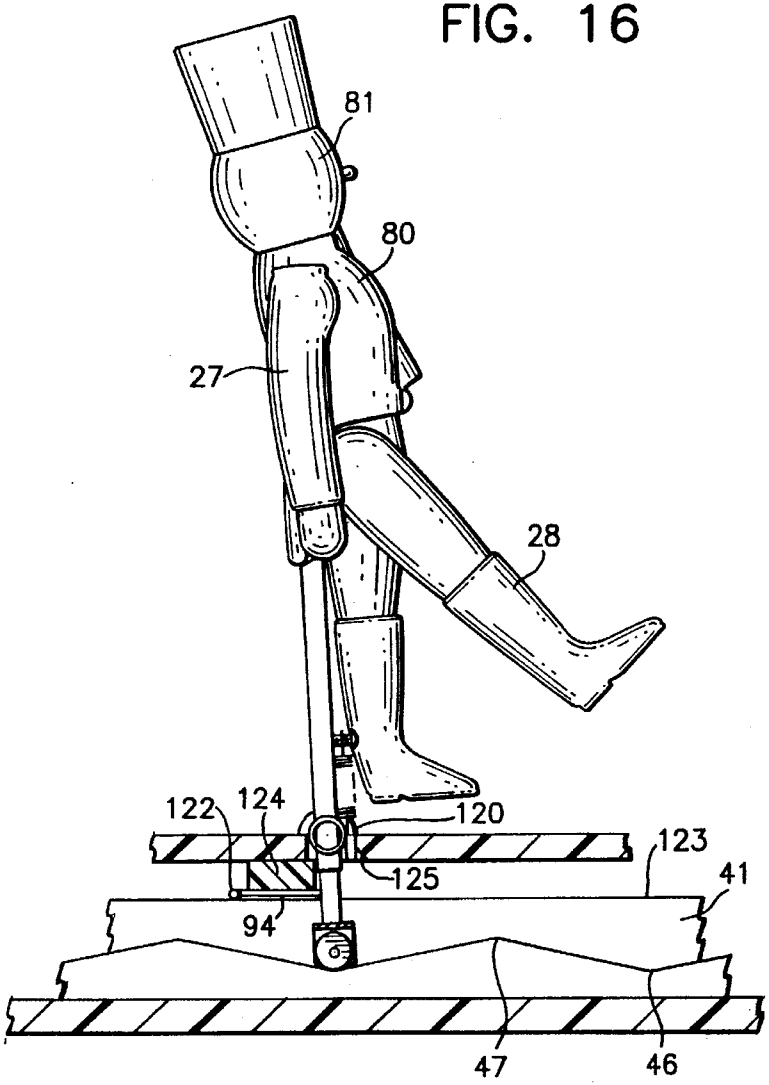
FIGS. 15–18 are side elevation views of the object showing its controlled rearward movement and its return to its original position.
Figure 15:
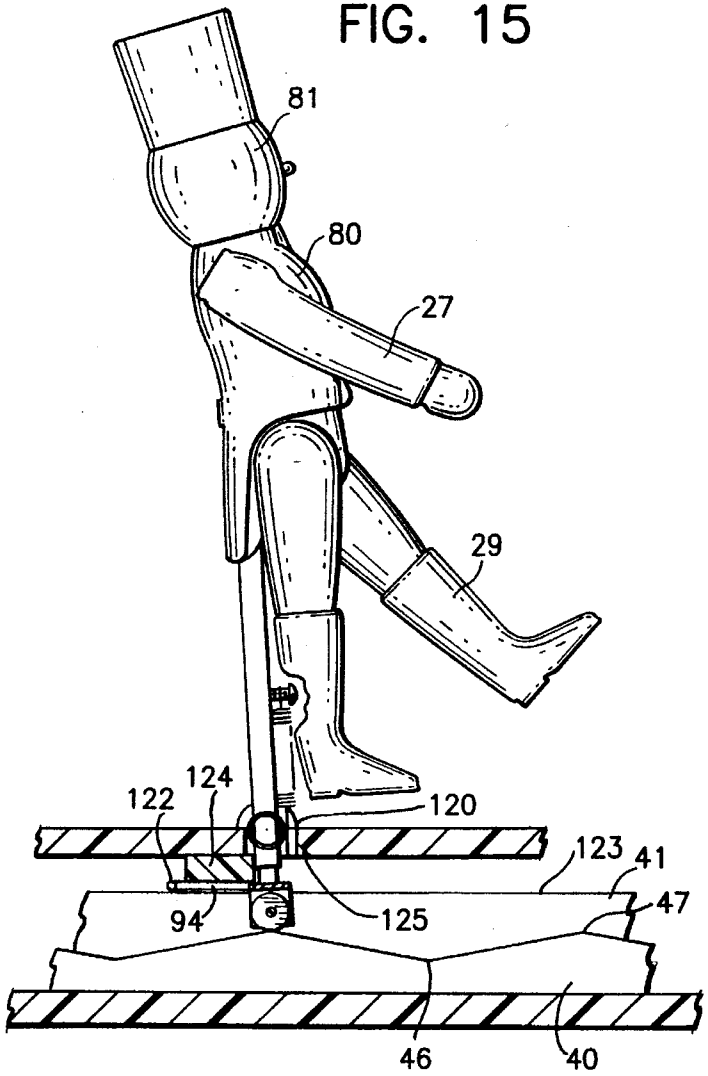
Figure 18:
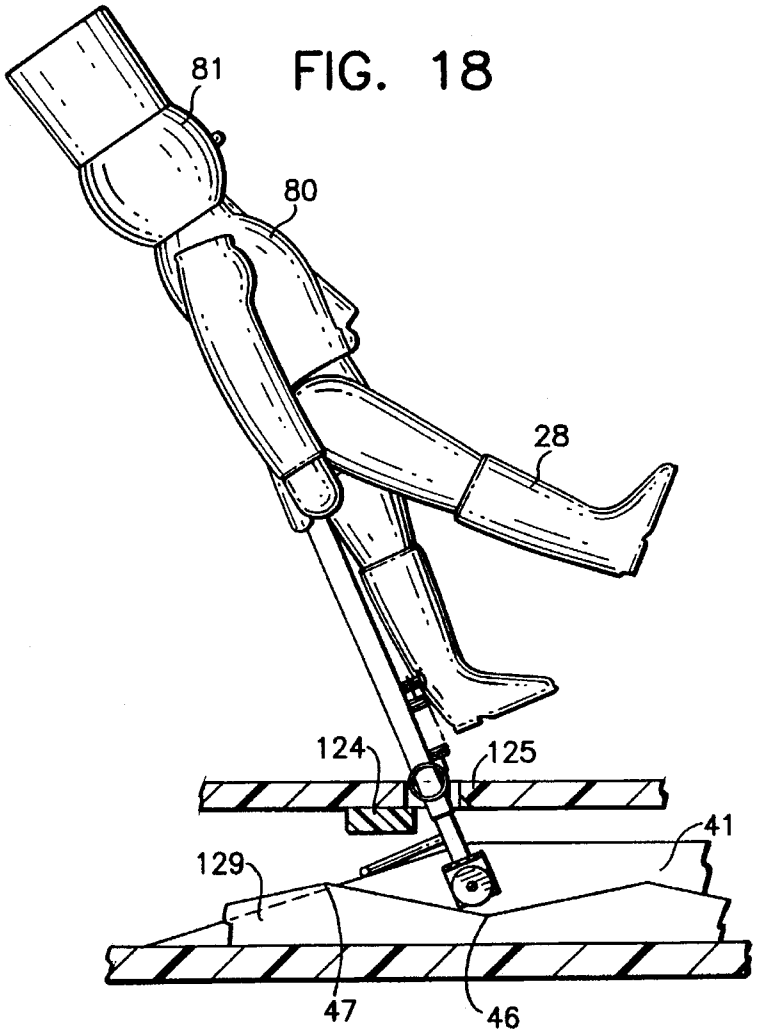
Figure 17:
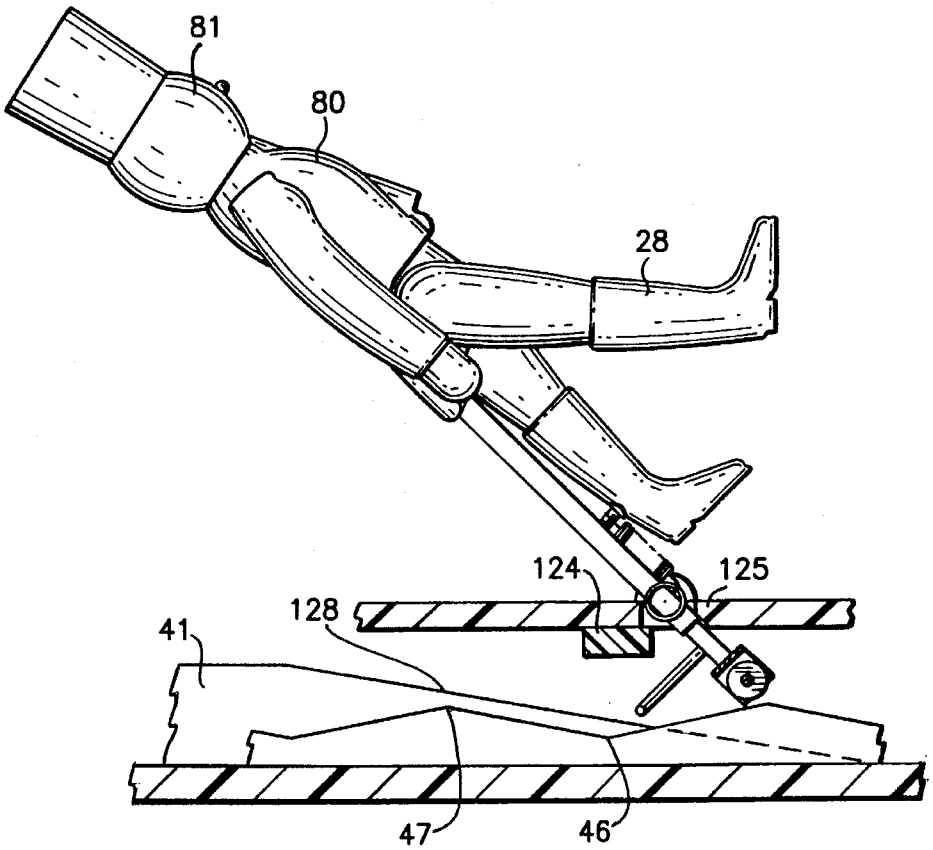

By referring to FIGS. 12–14, along with this following detailed disclosure, the controlled movement of arms 27 and legs 28 and 29 by support assembly 90 can best be understood. As detailed above, elongated rod 92 is axially movable within elongated hollow shaft 91 between two alternate positions. In order to control the movement of rod 92 within shaft 91, support assembly 90 is positioned on carriers 24 and 25 so as to assure cam follower/roller 95 is in continuous engagement with upstanding camming rail 40. In this regard, whenever cam follower/roller 95 is in contact with a peak 46 of rail 40, rod 92 is in its fully engaged position within shaft 91. Similarly, whenever cam follower/roller 95 is in contact with valley 47 of rail 40, elongated rod 92 is in its downwardmost position with posts 96, 97 and 98 engaging the lower portions of slots 99.

In its normal operation, soldier support assembly 90 is secured to carriers 24 and 25 by cylindrical support tube 93. In this regard, although capable of pivoting movement relative to carriers 24 and 25, as detailed below, the mounted engagement of support tube 93 with carriers 24 and 25 prevents elongated hollow shaft 91 from having any vertical movement. However, elongated rod 92 is coaxially aligned with shaft 91 and is capable of longitudinal coaxial motion relative to shaft 91. It is this coaxial, substantially vertical movement which causes right arm 27 and legs 28 and 29 to move in the precisely desired directions.

When cam follower/roller 95 is in contact with valley 47 of rail 40, arm 27 is substantially along the side of body portion 80 while right leg 28 is pivoted in its forward direction and left leg 29 pivoted in its rearward direction. As the movement of carriers 24 and 25 advance, cam follower/roller 95 moves upwardly along rail 40 towards peak 46, causing elongated rod 92 to be forced vertically upwardly through hollow shaft 91, causing posts 96, 97, and 98 to move upwardly simultaneously therewith. In addition, bar 100 and fastening means 101 also move in the same upward direction.

As post 96 moves upwardly, coil spring 107 is expanded, causing spring 107 to be placed under tension. In addition, control wire 108 is drawn upwardly causing left leg 29 to be swung forwardly in view of the mounted engagement of wire 108 with leg 29. Similarly, wire 109 moves upwardly due to the movement of posts 98, causing right leg 28 to swing rearwardly due to the engagement of the terminating end of wire 109 with a rear portion of right leg 28. In addition, bar 100 is also simultaneously moved upwardly, being brought into contact with radial pin 83 extending from support rod 82. As rod 92 continues to advance upwardly through shaft 91, the upward movement of bar 100 is maintained in contact with pin 83 causing rod 82 to axially rotate, which in turn causes right arm 27 to be swung forwardly.

Once cam follower/roller 95 has reached peak 46 of rail 40, right arm 27 is raised to its highestmost point and left leg 29 has been swung forwardly to its furthest extent, while right leg 28 has been swung rearwardly to its fullest extent. In this way, the desired motion of arm 27 and legs 28 and 29 are attained in a fully controlled, repeatable, dependable manner.

As carriers 24 and 25 continue to advance along track 21, cam follower/roller 95 moves downwardly along the slope of rail 40 heading towards the next valley 47. With coil spring 107 having been extended, the spring forces continuously act on posts 96, causing rod 92 to move downwardly with shaft 91 automatically returning elongated rod 92 to its original fully extended position once valley 47 has been reached. During this advance from peak 46 to valley 47, connecting wires 108 and 109 cause legs 29 and 28 to move in the opposite pivotable direction, while bar 100 is removed from engagement with pin 83, causing arm 27 to pivot downwardly due to gravitational forces.

By employing this construction, the desired controlled motion of soldiers 23 is attained and the precisely desired visually pleasing marching appearance is realized. This appearance is further enhanced by positioning soldiers 26 relative to each other, so that each soldier support assembly 90 is in an identical position on rail 40.

As a result of this construction, each soldier 26 is positioned on a peak 46 of rail 40 at the same time as the other soldiers, while also being positioned at a valley 47 at precisely the same time. In this way, the arm and leg movements of each soldier are identical and the visual impression of a plurality of soldiers marching in synchronization with each other is attained. By employing this embodiment of the present invention, a principal aspect of the present invention is realized and prior art drawbacks are overcome in a system which is completely mechanical and capable of being manufactured without expensive control equipment.

In addition to advancing objects 26 about track 21 in a manner which causes the objects to continuously perform particular movements in synchronization with each other, entertainment system 20 of the present invention also enables objects 26 to perform a completely different, special, "attention-grabbing" action at least once during each complete cycle around track 21.

In the preferred embodiment detailed herein, objects or soldiers 26 are mounted to carriers 24 and 25 in a manner which enables soldiers 26 to pivot rearwardly at a specific location along track 21, each time carriers 24 and 25 complete a circle about track 21 and reach one specific position. As detailed above, in the preferred embodiment, the leading soldier 26 falls back rearwardly in a completely controlled manner followed by the second soldier 26 also falling rearwardly as the first soldier has reached its maximum rearward pivoting movement. This process then continues until all soldiers 26 have fallen rearwardly, providing a visually simulating rearward toppling effect.

Once all of the soldiers have been pivoted rearwardly to the maximum extent, this position is retained for a short time period and then the first soldier 26 is automatically raised upwardly to its normal position, resuming its arm swinging and leg swinging, marching advance. This is followed by the second soldier being raised upwardly with each subsequent soldier repeating the identical motion until all of the soldiers 26 have been raised to their fully erect position, marching in synchronization with each other.

By referring to FIGS. 1 and 15–18, along with the following detailed disclosure, the preferred construction for attaining this unique visually exciting movement can best be understood. As discussed above, each soldier 26 is mounted on a soldier support assembly 90 which is affixed to carriers 24 and 25. In order to enable soldiers 26 to be pivotable relative to support base 60 of carriers 24 and 25, each soldier is mounted in soldier-receiving slot 61 of support base 60 with the cylindrical support tube 93 of soldier support assembly 90 pivotally secured to collars 120 and 121.

In the preferred construction, each collar 120 and 121 is mounted to support base 60 of carriers 24 and 25 and incorporates a tube-receiving recess formed therein. Once securely mounted in the desired position, cylindrical support tube 93 of support assembly 90 is securely supported in collars 120 and 121, while also being arcuately pivotable therein.

Furthermore, in the preferred construction, each soldier 26 is mounted to its support assembly 90 with the center of gravity of soldier 26 being rearward of the central axis of support assembly 90. As a result, the natural forces acting upon soldier 26 and support assembly 90 causes soldier 26 with support assembly 90 to pivot rearwardly about the central axis of support tube 93, unless acted upon by another force.

In order to maintain each soldier's marching position, a lifting force must be exerted upon the soldier 26 and continuously maintained therewith in order to prevent rearward movement of soldier 26, until desired. In order to provide the requisite lifting force for maintaining soldier 26 fully erect, whenever desired, control arm 94 is in employed in combination with upstanding rail 41.

When objects 26 are in their normally erect position, rail engaging rod 122 of control arm 94 is in sliding contact with the upper, exposed edge or surface 123 of rail 41. As a result of the configuration employed for control arm 94 and its position relative to support tube 93, the engagement of engaging rod 122 with surface 123 of rail 41 maintains support assembly 90 in the vertically erect position, with support assembly 90 and soldier 26 maintained substantially perpendicular to support base 60 of carrier 24. Preferably, soldier 26 and support assembly 90 are maintained at a slight rearward angle, in order to assure the desired motion is easily attained. Typically, an angle of between 3° and 5° from vertical is preferred.

In addition, in the preferred embodiment, support base 60 also incorporates a stopping block 124 mounted adjacent the rear edge of each soldier receiving slot 61 in order to prevent soldier support assembly 90 from pivoting beyond the desired substantially perpendicular position. In addition, block 124 is positioned to establish and maintain the slight rearward angle. Furthermore, the front edge of each soldier receiving slot 61 incorporates a chamfer zone 125 in order to assure that soldier support assembly 90 can arcuately pivot in the manner desired without any interference from support base 60 of carrier 24, as well as carrier 25.

In order to enable each soldier 26 to perform the unique, visually exciting rearward fall, in order to enhance entertainment system 20, rail 41 incorporates a downward sloping portion 128. As supporting base 60 of carrier 24 advances along track 21, rail engaging rod 122 of the first soldier 26 moves from contacted engagement with upstanding terminating edge 123 of rail 41 to downward sloping surface 128. As rail engaging rod 122 of control arm 94 moves from surface 123 to surface 128, the secure, erect positions originally maintained by rail engaging rod 122 is altered and soldier 26 begins to pivot rearwardly due to its center of gravity being located behind support assembly 90. As a result, when soldier 26 is no longer held in a vertical position due to the contact between rail engaging rod 122 and surface 123, soldier 26 pivots rearwardly about the axis defined by support tube 93. This rearward movement by soldier 26 is controlled by the sliding interengagement of rail engaging rod 122 and slope surface 128 of rail 41.

Since carriers 24 and 25 continue to advance along track 21 in a substantially horizontal manner, the vertical distance between sloping surface 128 and support base 60 of carriers 24 and 25 continues to increase. As a result, soldier 26 is able to continuously pivot rearwardly until rail engaging rod 122 of control arm 94 is no longer in contact with rail 41, at which time soldier 26 has pivoted rearwardly to its maximum extent.

In the preferred embodiment, sloping surface 128 of rail 41 comprises an angle which enables each soldier 26 to pivot rearwardly in a smooth, controlled manner, while avoiding sudden, rapid, arcuate movement. Of course, if desired, any type of pivoting motion can be attained by controlling the slope of surface 128. In addition, the preferred embodiment is constructed to enable the first soldier to pivot almost entirely rearwardly before the second soldier 26 begins its rearward pivoting motion. In this way, the visual effect of the first soldier causing the second soldier to fall rearwardly is enhanced. This process is then repeated until all of the soldiers have pivoted to the full rearward position.

Once all of the soldiers are in their fully pivoted position and this position has been maintained for a desired length of time, carriers 24 and 25 advance into aligned engagement with upwardly sloping surface 129 of rail 41. As carriers 24 and 25 are electronically advanced, as detailed above, rail engaging rod 122 of control arm 94 is brought into sliding engagement with upwardly sloping surface 129 of rail 41, with rail engaging rod 122 being advanced into sliding interengagement therewith advancing up the slope thereof. As a result of this engagement, support assembly 90 is arcuately pivoted about the axis defined by support tube 93, causing soldier 26 to be raised from its rearward fallen position to its original vertical position. Of course, the vertical position is attained when rail engaging rod 122 moves from upward sloping surface 129 to exposed top surface 123. Once in this position, soldier 26 has been returned to its original substantially vertical orientation with support assembly 90 fully engaged with rail 40, in order to cause the arm and leg marching movements of each soldier to be initiated and maintained as carriers 24 and 25 continue to advance along track 21.

As is apparent from this disclosure, this construction of the present invention enables soldiers 26 to provide a continuous visual activity, representing marching soldiers as the soldiers 26 continue to advance around track 21. In addition, a unique, separate and distinct activity is also provided during each continuous path, wherein a completely different and unexpected action is attained. As detailed above, this action visually displays the soldiers 26 as falling rearwardly and then automatically returning to their original erect positions.

As apparent from this disclosure, a unique entertainment system 20 is realized providing a high level of excitement, interest and entertainment which has previously been unattainable with prior art systems. In order to further enhance the interest and excitement provided by entertainment system 20, the present invention also incorporates musical accompaniment which is automatically activated as carriers 24 and 25 advance along track 21. In the preferred embodiment, three separate musical songs are provided with each song being activated when the leading edge of carrier 24 reaches a particular location, with the music being deactivated when carrier 25 advances away from that particular position.

Figure 19:
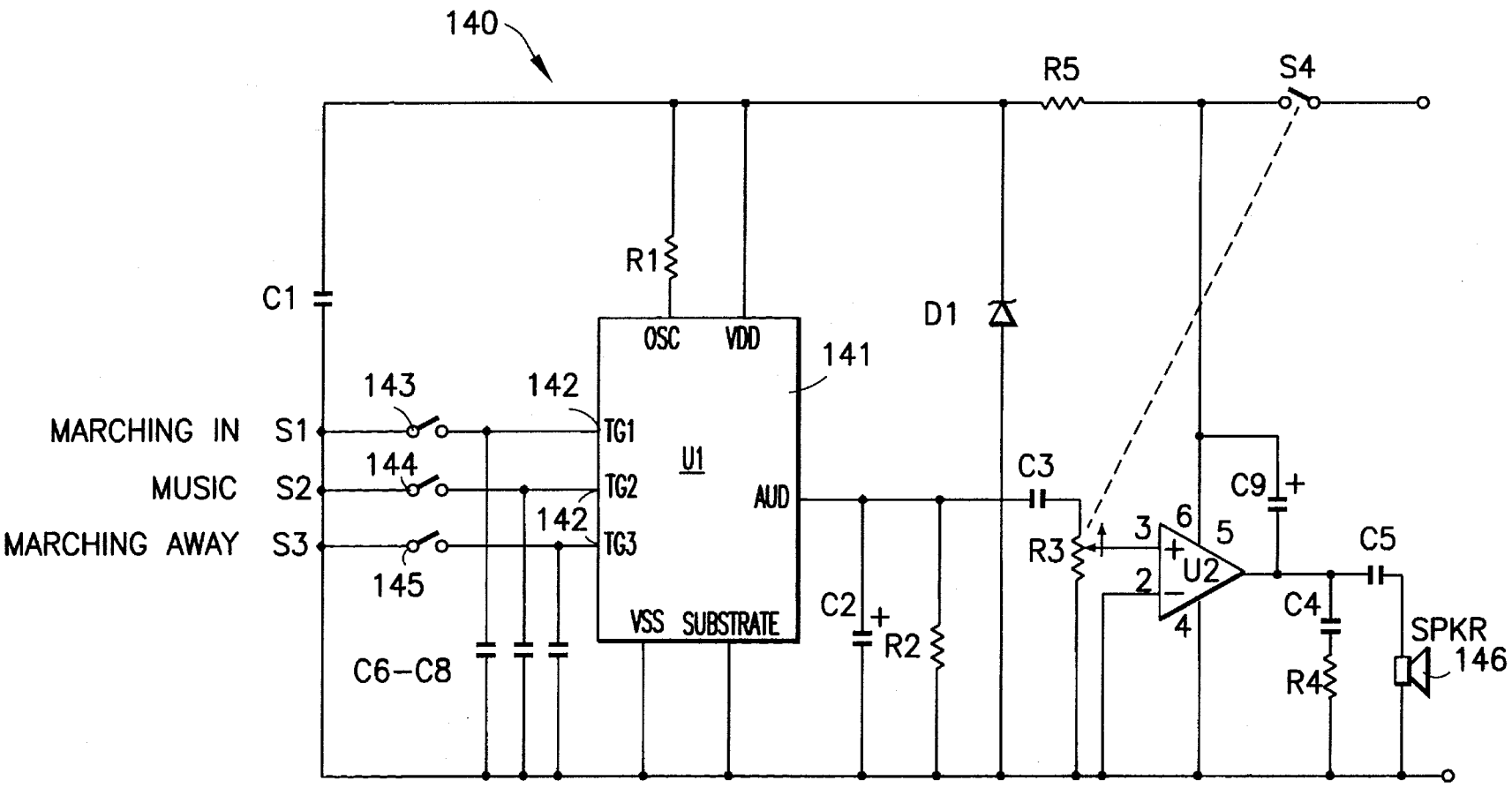
FIG. 19 is a schematic circuit diagram depicting the preferred electronic circuit employed for providing music with the entertainment system of the present invention.

In FIG. 19, a schematic circuit diagram is provided showing the preferred embodiment for generating the desired musical accompaniment with entertainment system 20 with three separate switches being shown for activating the three desired songs or melodies. By referring to FIGS. 2–19, along with the following detailed disclosure, the construction and operation of the switch members and the music producing circuit can best be understood.

Music producing circuit 140 comprises a music producing chip or integrated circuit 141 which is capable of providing the desired output for generating three separate and distinct songs or melodies. By activating one of the triggers 142 of integrated circuit 141, the desired musical song or melody is produced.

In order to control the particular music being generated by circuit 140, switches 143, 144, and 145 are employed. By sequentially activating one of the switches 143, 144, or 145, the desired trigger is activated of integrated circuit 141 and the precisely desired musical melody or song is transmitted to speaker 146.

In order to attain the desired activation of circuit 140, switches 143, 144, and 145 are mounted in precisely desired locations on track 21. For exemplary purposes, FIG. 2 depicts switch 143 mounted to track segment 22. As depicted, switch 143 is mounted to base 35 of track segment 22 with lever arm 150 extending from switch 143 through aperture 151 formed in side rail 36. In this way, whenever carrier 24 advances between side rails 36 and 37, a portion of carrier 24 contacts lever arm 150 causing lever arm 150 to pivot towards aperture 151, simultaneously activating switch 143. This activation is transmitted along wires 152 to connector 153 which is interengaged with circuit 140. This activation signal is transmitted to the associated trigger 142 of integrated circuit 141, thereby activating the particular music associated with switch 143.

While carriers 24 and 25 continue to advance along lever arm 150, switch 143 remains activated. However, once carrier 25 has cleared lever arm 150, lever arm 150 pivots back to its original position, thereby deactivating switch 143 and stopping the musical song or melody being played. By positioning switches 143, 144, and 145 at precisely desired locations about track 21, the desired songs or melodies are automatically activated and deactivated in the precisely desired sequence, along with the precisely desired interim time period in which no music is being played. In addition, if desired, four or more switches can be employed along track 21 with the switches being connected to circuit 140 to replay any song or melody that has already been played.

As is apparent from the foregoing detailed disclosure, the present invention attains an entertainment system which achieves visual and audible stimulation, excitement and interest by providing a unique display previously unattainable. By employing movable objects capable of continuously performing a particular function in a synchronized, repeatable, fashion, as well as performing a unique and totally different function at least once every cycle, a unique, exciting and interesting entertainment system is attained.

It will thus be seen that the objects set forth above, among those made apparent from the preceding description are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described our invention, what we claim as new and desire to secure by Letters Patent is:

1. An entertainment system providing a plurality of automatic movable objects constructed for following a defined path and performing at least one repeatable activity, said system comprising:

A. an elongated path defining member;

B. a carrier cooperatively associated with the path defining member for movement thereon C. a plurality of objects a. mounted to the carrier for movement along the path member;

b. each of said objects performing a first activity in synchronization with each other, c. each of the objects being pivotally mounted to the carrier for enabling each object to pivot about a pivot axis relative to the carrier from a first position to a second position, D. movement control means cooperatively associated with the object for advancing the object along the path defining member;

E. first control means mounted to the object for causing the object to repeatedly perform a first desired activity or movement on a repeatable basis, while the object advances along the path defining member; and F. second control means a. cooperatively associated with the object for causing the object to perform a second desired activity or movement each time the object traverses at least one particular location on the path defining member, b. constructed for controllably moving each object from its first position to its second position each time said object traverses a first zone on the path defining member and controllably returning each object from its second position to its first position each time the object traverses a second zone on the path defining member, whereby each object is capable of providing a second, unique activity or movement every time each object traverses a first zone and automatically returns to its original position every time the object traverses the second zone, and comprising c. first means for maintaining each object in its first position, comprising 1. a plate member mounted to the elongated path defining member and comprising a terminating edge spaced away from a surface of the path defining member a fixed distance which extends substantially the entire length thereof, and 2. a follower arm mounted to the pivotable object and positioned for cooperative association with the plate member for controlling the pivoting action of the object and preventing arcuate movement of the object about the pivot axis when said follower arm is in contact with the terminating edge of the plate, d. second means for enabling each object to arcuately pivot from its first position into its second position, and e. third means for causing each object to arcuately pivot from its second position to its first position, whereby an entertainment system is attained which is capable of providing simultaneous movement of an object about a path while also having the object perform a first desired activity on a continuing and repeatable basis, and also performing a second separate and distinct activity at specifically designated locations.

2. The entertainment system defined in claim 1, wherein said carrier further comprises a motor cooperatively associated with the path defining member for advancing along the path defining member in a controlled motor driven manner.

3. The entertainment system defined in claim 1, wherein said object is further defined as comprising a figure with arms and legs and the repeatable first activity comprises moving at least one arm and at least one leg.

4. The entertainment system defined in claim 3, wherein said first control means comprises a. drive means controllably connected to the movable arm and leg of each figure for controllably moving the arm and leg in the desired manner on a continuously repeating basis.

5. The entertainment system defined in claim 4, wherein said drive means of the first control means is further defined as comprising 1. an elongated rod i. mounted in the figure, and ii. movable along a central axis thereof between a first position and a second position, and 2. a rotation producing means cooperatively associated with the rod and the movable arm and the leg of the figure for causing the arm and leg to arcuately move in response to the movement of the rod between its first and second positions.

6. The entertainment system defined in claim 5, wherein said first control means is further defined as comprising b. rod control means cooperatively associated with the rod for causing the elongated rod to move from its first to its second position, and c. spring means cooperatively associated with the rod for automatically returning the rod from its second position to its first position.

7. The entertainment system defined in claim 6, wherein said rod control means is further defined as comprising cam means constructed for cooperating controlling interengagement with the elongated rod for repeatedly causing the rod to move from its first position to its second position.

8. The entertainment system defined in claim 4, wherein said cam means is further defined as comprising an elongated, upstanding camming plate mounted to the elongated path defining member and incorporating an exposed terminating edge formed by a plurality of interconnected, cooperating, ramped, sloping segments comprising an upward sloping segment positioned adjacent a downward sloping segment throughout the entire length thereof, and positioned for cooperative, controlled, interengagement with the terminating end of the rod member for controllably moving the rod member from its first position to its second position and allowing the rod member to return from its second position to its first position by the spring means.

9. The entertainment system defined in claim 1, wherein the second means of the second control means is further defined as comprising a ramped, downward sloping surface formed along at least one portion of the upstanding plate member and extending from the fixed distance edge of the plate member substantially to the surface of the path defining member for controllably enabling the figure to pivot about the pivot axis as the follower arm moves from the fully extended edge of the plate member to the sloping edge thereof.

10. The entertainment system defined in claim 9, wherein the third means of the second control means is further defined as comprising an upwardly sloping edge formed on the upstanding plate and positioned for cooperative association with the follower arm for controllably moving the figure from its fully pivoted second position to its first position as the follower arm advances along the upward sloping surface thereof.

11. The entertainment system defined in claim 1, wherein said elongated path defining member is further defined as comprising a plurality of interlocking segments readily interconnectable to adjacent segments for creating the elongated path along which the carrier traverses.

12. The entertainment system defined in claim 11, wherein said elongated path defining member is further defined as incorporating a conductive strip extending the entire length of the elongated path defining member and constructed for carrying electrical power for delivery to the motor mounted with said carrier, whereby said carrier is capable of advancing along said path defining member by the activation of said motor.

13. The entertainment system defined in claim 12, wherein each of the plurality of segments forming the path defining member is further defined as comprising a substantially U-shape, formed by a base and two integrally connected upstanding wall members.

14. The entertainment system defined in claim 13, wherein said conductive strip is further defined as being mounted in a side wall of said path defining member for cooperative relationship with the carrier for providing power delivery thereto.

15. The entertainment system defined in claim 11, wherein said carrier is further defined as comprising at least two separate and independent segments, each of which supportingly maintains at least one object.

16. The entertainment system defined in claim 15, wherein said carrier is further defined as incorporating a plurality of locking tabs mounted thereto for movable interengagement with the path defining member for assuring smooth, continuous, trouble-free movement of the carrier along said path defining member.

17. The entertainment system defined in claim 1, wherein said system is further defined as comprising E. sound generating means cooperatively associated with the elongated path defining member and comprising
   a. sound producing means for providing a desired sound output for being heard by the user;
   b. switch means mounted along the elongated path defining member and connected to the sound producing means for controlling the operation of the sound producing means and positioned for cooperative interengagement with the carrier for activation and deactivation in response to movement of the carrier along said path defining member.

18. An entertainment system providing at least one automatic, movable object constructed for following a defined path and performing at least two separate and distinct repeatable activities, said system comprising A. an elongated, continuous path defining member formed by a plurality of segments each readily interconnectable to adjacent segments for creating said continuous elongated path;

B. a carrier cooperatively associated with the elongated path defining member for continuous movement therealong when activated;

C. a drive motor mounted to the carrier and cooperatively associated with the path defining member for advancing the carrier along the path defining member;

D. at least three objects mounted to the carrier for movement therewith along the path defining member, with each of said objects being constructed for performing substantially identical movements in synchronization with each other and being pivotally mounted to the carrier for enabling each object to pivot about a pivot axis relative to the carrier from a first position, to a second position,;

E. first control means mounted to each of said objects for causing each object to repeatedly perform a first desired activity as the object advances along the path defining member, said first control means comprising
   a. drive means controllably connected to each figure for moving each figure in the desired manner on a continuously repeating basis, and
   b. cam means positioned in cooperating, controlling relationship with said drive means for controllably moving the drive means;

F. second control means cooperatively associated with each object for causing each object to perform a second desired activity or movement each time the object passes at least one particular location on the path defining member, said second activity or movement being further defined as causing the object to move substantially in its entirety between a first position and a second position each time said object traverses a first zone on the path defining member and controllably returning each object from its second position to its first position each time the object traverses a second zone on the path defining member, whereby each object is capable of providing a second, unique activity or movement every time each object traverses a first zone and automatically return to its original position every time the object traverses the second zone, said second control means comprising
   a. first means for maintaining each object in its first position,
   b. second means for enabling the object to move substantially in its entirety from its first position to its second position, and
   c. third means for causing each object to move substantially in its entirety from its second position to its first position; and G. sound generating means cooperatively associated with the elongated path defining member and comprising
   a. sound producing means for providing a desired sound output for being heard by the user;
   b. switch means mounted along the elongated path defining member and connected to the sound producing means for controlling the operation of the sound producing means and positioned for cooperative interengagement with the carrier for activation and deactivation in response to movement of the carrier along said path defining member.

19. The entertainment system defined in claim 18, wherein said object is further defined as comprising a figure with arms and legs and the repeatable first activity comprises moving at least one arm and at least one leg, and said drive means of the first control means is further defined as comprising 1. an elongated rod
   i. mounted in the figure, and
   ii. movable along a central axis thereof between a first position and a second position, and
2. a rotation producing means cooperatively associated with the rod and the movable arm and the leg of the figure for causing the arm and leg to arcuately move in response to the movement of the rod between its first and second positions.

20. The entertainment system defined in claim 19, wherein said first control means is further defined as comprising b. rod control means cooperatively associated with the rod for causing the elongated rod to move from its first to its second position, and
c. spring means cooperatively associated with the rod for automatically returning the rod from its second position to its first position.

21. The entertainment system defined in claim 20, wherein said rod control means is further defined as comprising cam means constructed for cooperating controlling interengagement with the elongated rod for repeatedly causing the rod to move from its first position to its second position.

* * * * *